US012239273B2

(12) United States Patent
Dirnberger et al.

(10) Patent No.: US 12,239,273 B2
(45) Date of Patent: Mar. 4, 2025

(54) COVER ASSEMBLY FOR MOUNTING IN A DOMESTIC DISHWASHER

(71) Applicant: emz-Hanauer GmbH & Co. KGaA, Nabburg (DE)

(72) Inventors: Albert Dirnberger, Neunburg vorm Wald (DE); Johann Kleber, Nabburg (DE); Matthias Bauer, Schmidgaden (DE); Georg Spießl, Altendorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 296 days.

(21) Appl. No.: 17/737,096

(22) Filed: May 5, 2022

(65) Prior Publication Data

US 2022/0354336 A1 Nov. 10, 2022

(30) Foreign Application Priority Data

May 7, 2021 (DE) ..... 102021112035.7

(51) Int. Cl.
*A47L 15/42* (2006.01)
*A47L 15/44* (2006.01)

(52) U.S. Cl.
CPC ..... *A47L 15/4265* (2013.01); *A47L 15/4263* (2013.01); *A47L 15/44* (2013.01)

(58) Field of Classification Search
CPC ... A47L 15/4265; A47L 15/4263; A47L 15/44
USPC ..... 134/58 D
See application file for complete search history.

(56) References Cited

U.S. PATENT DOCUMENTS

2001/0013357 A1* 8/2001 Matsuno ..... A47L 15/4261 134/201
2011/0247663 A1* 10/2011 Gadini ..... A47L 15/4454 222/173
2017/0143184 A1* 5/2017 Wegener ..... D06F 39/026
2020/0178756 A1* 6/2020 Boyer ..... D06F 39/02

FOREIGN PATENT DOCUMENTS

CN 108591243 A 9/2018
CN 111728555 A 10/2020
DE 4419116 A1 12/1995
DE 102015120400 A1 6/2017
WO 2007128698 A1 11/2007

* cited by examiner

*Primary Examiner* — Tinsae B Ayalew/ Exam
(74) *Attorney, Agent, or Firm* — Hayes Soloway PC

(57) ABSTRACT

A cover assembly for mounting in a domestic dishwasher, for example, is proposed. The cover assembly includes a pivoting cover which is mounted on a support component and is to close an opening, wherein the pivoting cover has a cover part and a closure part which is movable relative to the cover part. The cover part has sealing faces which, on closing of the pivoting cover, come into sealing contact with sealing counter-faces encircling the opening. There are formed on the closure part engagement formations which, in a closed pivot position of the pivoting cover, can be brought into and out of holding-closed engagement with engagement counter-formations by relative movement between the closure part and the support component. The cover part is mounted on the closure part and is supported via the closure part on the support component.

12 Claims, 8 Drawing Sheets

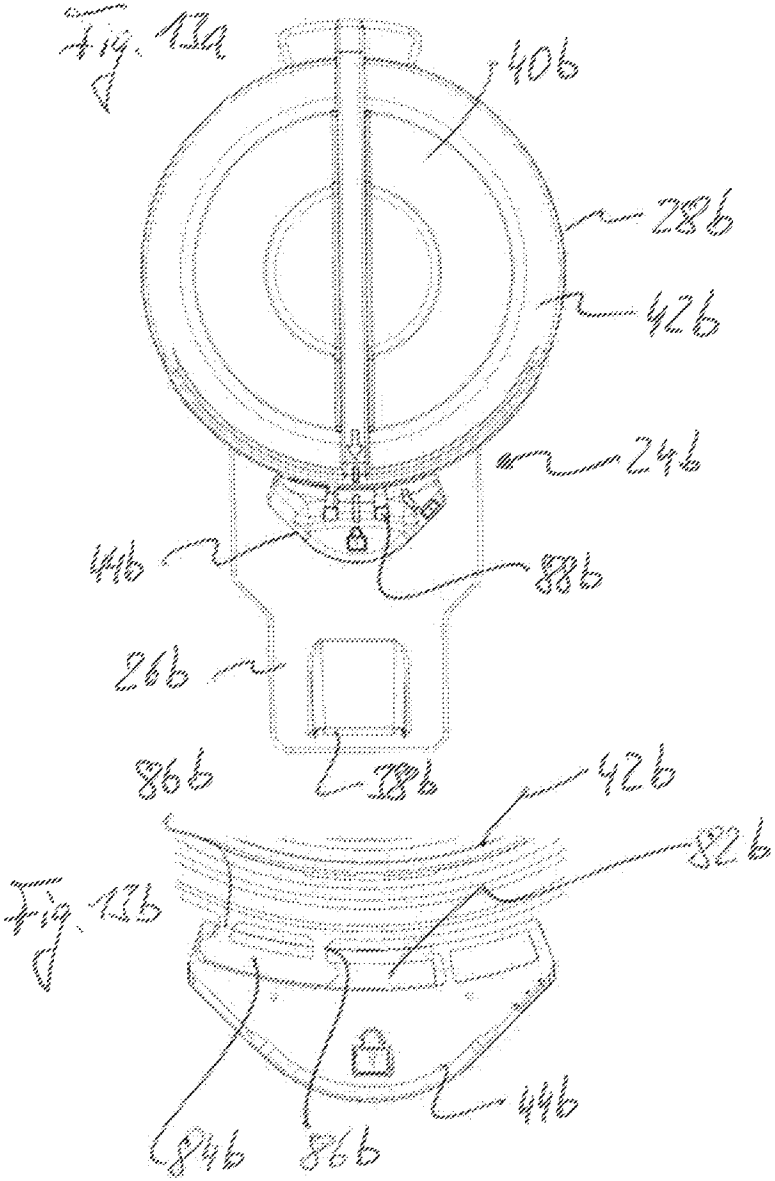
40b
28b
42b
24b
88b
38b
26b
46b
Fig. 12a
42b
82b
44b
86b
84b
86b
Fig. 12b
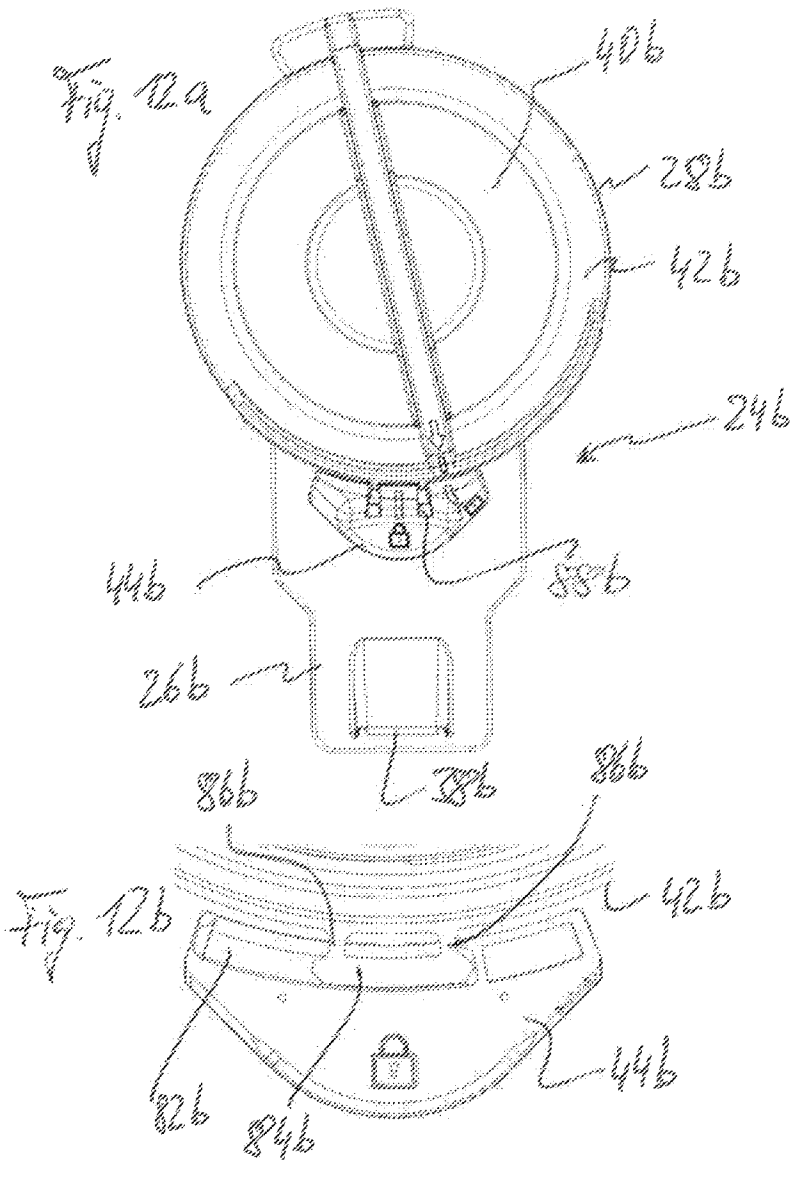
40b
28b
42b
24b
88b
38b
26b
46b
Fig. 12a
86b
42b
44b
84b
86b
82b
Fig. 12b

COVER ASSEMBLY FOR MOUNTING IN A DOMESTIC DISHWASHER

CROSS-REFERENCE TO RELATED APPLICATIONS

This application claims priority to German Patent Application 10 2021 112 035.7, filed on May 7, 2021, the contents of which are incorporated by reference herein.

TECHNICAL FIELD

The invention relates to a cover assembly for mounting in a domestic dishwasher or other domestic electrical appliance in which it is necessary to tightly close an opening.

BACKGROUND

In domestic dishwashers, such an opening can, for example, provide access to inner regions of a dosing system which serves to deliver a detergent in a dosed manner into the dishwashing chamber of the dishwasher. Because the detergent stored in the dosing system can be adversely affected by the penetration of spray or hot steam, it is desirable to be able to tightly close the opening. In this respect, DE 10 2015 120 400 A1 discloses a two-part cover construction with a cover plate and a bayonet ring surrounding the cover plate. The cover plate is pivotably mounted on a housing of a supply magazine, while the bayonet ring is mounted on the cover plate so as to be rotatable relative thereto. The cover construction serves to close an opening formed in the housing and providing access to a receiving chamber into which a supply cartridge for a detergent powder can be inserted. When the cover construction is closed, the cover plate comes into contact with a sealing ring arranged on the housing and extending all around the opening. By relative rotation of the bayonet ring with respect to the cover plate, locking elements formed on the bayonet ring can be brought into bayonet engagement with locking fingers formed on the housing.

A disadvantage associated with this known cover construction is that the cover plate only has pivotability relative to the housing in which the opening is formed.

By contrast, the invention provides a cover assembly for mounting in a domestic dishwasher or similar domestic appliance, comprising a pivoting cover which is mounted on a support component and is to close an opening, wherein the pivoting cover has a cover part and a closure part which is movable relative to the cover part, wherein the cover part has sealing faces which, on closing of the pivoting cover, come into sealing contact with sealing counter-faces encircling the opening, wherein there are formed on the closure part engagement formations which are configured to be brought, in a closed pivot position of the pivoting cover, into and out of holding-closed engagement with engagement counter-formations by relative movement between the closure part and the support component. According to the invention, it is provided in such a cover assembly that the cover part is mounted on the closure part and is supported via the closure part on the support component.

SUMMARY

In the solution according to the invention, the cover part is supported on the support component only indirectly, namely with interposition of the closure part. Owing to the movable mounting of the cover part on the closure part, movability of the cover part relative to the support component is also provided. On closing of the opening, this movability of the cover part can result in improved sealing contact of the sealing faces of the cover part with the sealing counter-faces and can make it possible to reduce the force for the relative movement between the closure part and the support component which is required to establish the holding-closed engagement.

In some embodiments, the opening is formed in the support component. However, it is equally conceivable that the opening is formed in a component separate from the support component. Correspondingly, the sealing counter-faces can be arranged on the support component or on such a separate component.

In some embodiments, the closure part is mounted on the support component via a pivot bearing which, in addition to a relative pivoting movement between the closure part and the support component, at least in the closed pivot position of the pivoting cover permits a relative movement between the closure part and the support component in order to establish and release the holding-closed engagement. In other embodiments, the cover assembly comprises an intermediate component which is pivotably mounted on the support component and on which the closure part is mounted for relative movement in order to establish and release the holding-closed engagement.

Some embodiments provide that at least part of the sealing faces is formed by an elastomer seal arranged on the cover part. Nevertheless, it is not impossible, alternatively or additionally, that part of the sealing counter-faces is formed by an elastomer seal which is arranged on a component that contains the opening (e.g. the support component or a component separate therefrom).

According to some embodiments, the cover assembly comprises a circumferential sealing element which forms at least part of the sealing faces or of the sealing counter-faces and which has a pair of flexibly deflectable radial sealing lips which are offset axially with respect to an axis of revolution normal to a plane of revolution of the sealing element and extend in the same radial direction. In particular, it can be provided in this case that the two radial sealing lips have different radial extents, so that one of the radial sealing lips protrudes radially beyond the other of the radial sealing lips.

In some embodiments, the cover part is configured in the manner of a circular disk part, wherein the closure part comprises an annular region surrounding the cover part and is rotatable relative to the cover part for establishing and releasing the holding-closed engagement. Other geometries of the cover part and other movement patterns of the closure part are also conceivable within the scope of the invention; for example, it is conceivable to configure the cover part in the manner of a quadrangular plate part, in which case the closure part can form a quadrangular frame surrounding the cover part and can be linearly displaceable relative to the cover part for establishing and releasing the holding-closed engagement.

The engagement formations, together with the engagement counter-formations, can implement the function of a bayonet closure, for example. For this purpose, the engagement formations can have a plurality of engagement elements which are arranged distributed along the circumference of the cover and which, in the closed pivot position of the pivoting cover, can be moved beneath a respective engagement counter-element of the engagement counter-formations by movement of the closure component relative to the support component, whereby the pivoting cover is fixed in the closed pivot position. The engagement formations can be moved out of the effective range of the engagement counter-formations again by backward movement of the closure component relative to the support component; the pivoting cover can then be opened again.

In some embodiments, the cover part is configured to be non-transparent in a first region which is situated over the opening centrally or at least close to the center in the closed pivot position of the cover, while it is configured to be transparent, in particular all round, in a second region which surrounds the first region on the outside in an annular manner. Non-transparency in this sense can be achieved, for example, by an opaque form of the first region which allows light to pass to a certain extent but does not allow a user to see through the first region. Non-transparency can likewise be achieved by a light-impermeable form of the first region of the cover part. Such a form of the cover part that is non-transparent in the center or in the vicinity of the center and transparent radially on the outside can provide an aesthetically pleasing overall impression of the pivoting cover. This may be desirable, for example, when, with the cover assembly fitted and the pivoting cover closed, an annular magazine having a plurality of supply compartments which are arranged distributed in an annular arrangement and are each to hold one detergent tablet is arranged beneath the cover part (as is shown and described, for example, in German patent application no. 10 2021 110 759.8, the content of which is hereby incorporated in its entirety by explicit reference) and, although it is to be possible for the user to see the supply compartments in order to be able to check that they are filled with detergent tablets, he is to be prevented for aesthetic reasons from seeing a central region of the annular magazine. Of course, it is not impossible within the scope of the invention to configure the cover part so that it is transparent also in its central region and in particular substantially throughout. Alternatively or additionally, the first region of the cover part can be configured to be relatively raised and the second region to be relatively lowered.

According to some embodiments, the support component comprises an integrally connected portion in which there are formed the opening and, spaced apart from the opening, a detergent outlet. In such embodiments, the support component is configured not only with the opening but also with an outlet from which, during operation of the dishwasher, a portion (dose) of the detergent which has been taken from a detergent supply can emerge into the dishwashing chamber of the dishwasher. The opening and the outlet can thereby be formed in a portion of the support component that is integrally connected, for example formed in a single injection-molding process.

Some embodiments provide a damping device which acts between the support component and the pivoting cover and which effects a pivot resistance which begins from a defined pivot angle distance of the pivoting cover from the closed pivot position or/and becomes greater as the pivot angle distance from the closed pivot position increases. The defined pivot angle distance is, for example, not less than 60° or not less than 80° or not less than 90° from the closed pivot position of the pivoting cover. Such a damping device can prevent the pivoting cover from hitting, unchecked, an obstacle which may be located in the pivot path of the pivoting cover. For example, it may be that the pivot range of the pivoting cover is so great that it is possible that the pivoting cover, on opening, hits a dish rack of the dishwasher. Advantageously, the damping action of the damping device begins at a sufficient angular distance from the expected hitting position that the pivoting cover at most hits the object gently.

The pivot resistance can be caused, for example, by pressing a friction body against a bearing face. The required pressing force can be generated, for example, by wedge engagement of two faces of the support component and of the pivoting cover which are pivoted relative to one another on pivoting of the pivoting cover. The friction body can be a rubber-elastic body, for example.

The invention additionally provides a domestic dishwasher having a dishwashing container, a door which is mounted on the dishwashing container so as to be pivotable about a horizontal door pivot axis close to the floor and is to close a dishwashing chamber formed in the dishwashing container, and a dosing system, arranged on the door, for a solid detergent in powder or tablet form, for example. The dosing system defines a supply chamber, accessible through a charging opening, for holding a supply of the solid detergent, and a drop section, leading to an outlet, for a portion of the detergent extracted from the supply. The outlet allows the extracted detergent portion to emerge into the dishwashing chamber. In such a dishwasher, the dosing system comprises according to the invention a cover assembly of the type discussed hereinbefore for closing the charging opening.

BRIEF DESCRIPTION OF THE DRAWINGS

The invention will be explained in greater detail hereinbelow with reference to the accompanying drawings, in which:

FIG. 12*a* is a top view of the cover assembly of FIG. 9 in an unlocked state of the closure ring, FIG. 12*b* shows an enlarged detail of FIG. 12*a*, wherein part of the hinge component has been cut away, FIG. 13*a* is a top view of the cover assembly of FIG. 12*a*, but after the locking ring has been rotated into a locked state, and FIG. 13*b* shows an enlarged detail of FIG. 13*a*, wherein part of the hinge component has again been cut away.

DETAILED DESCRIPTION

Figure 1:
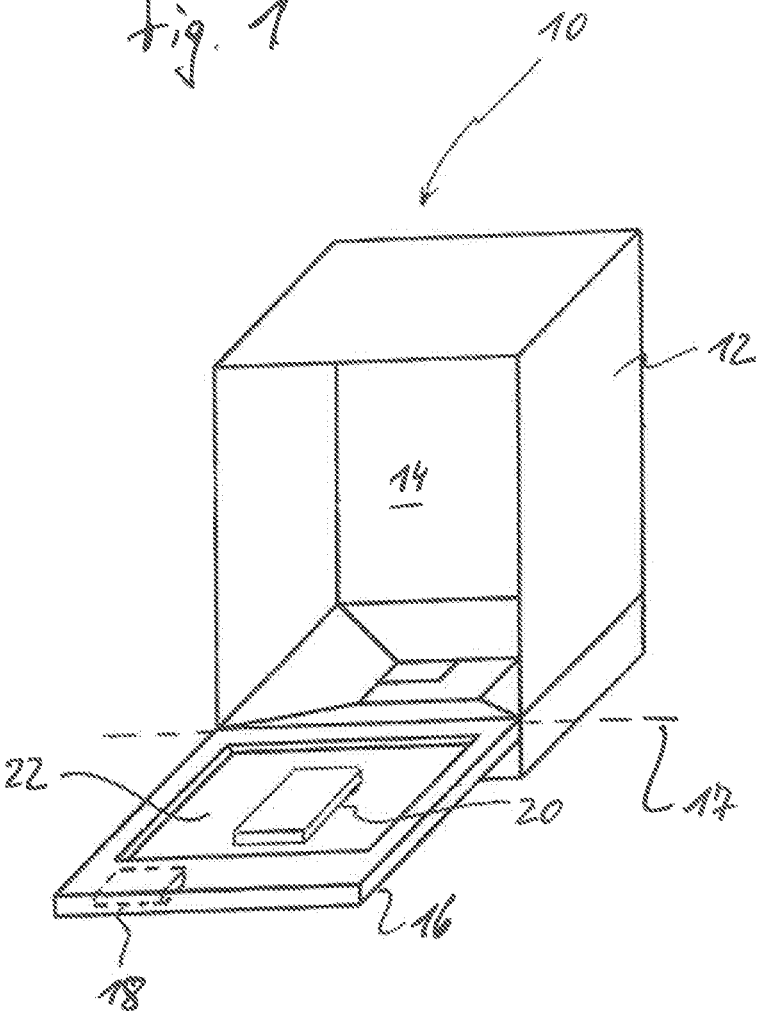
FIG. 1 shows, in diagrammatic form, a domestic dishwasher according to one embodiment.

Reference will first be made to FIG. 1. The dishwasher shown therein, which is provided for domestic use, is designated generally 10. It comprises a dishwashing container 12 in which a dishwashing chamber 14 is formed. Mounted on the dishwashing container 12 is a door 16 which is pivotable about a horizontal pivot axis 17 close to the floor. The door 16 can be pivoted between a fully open position shown in FIG. 1, in which it is located with its door plane substantially horizontal, and a closed position, in which it closes the dishwashing chamber 14 to the outside and stands substantially vertically. One or more dish racks and optionally a cutlery tray can be inserted into the dishwashing chamber 14 in a manner known per se in order to hold the dishes to be cleaned. A control unit 18, indicated by a broken line, is responsible for controlling the operation of the dishwasher 10. In the example shown, the control unit 18 is fitted into the door 16. It will be appreciated that, in other embodiments, at least parts of the control unit 18 can be arranged on the dishwashing container 12.

The control unit 18 is responsible not only for controlling the dishwashing operation and optionally a drying operation of the dishwasher 10 but also for controlling a dosing system 20, which is indicated only in diagrammatic form in FIG. 1 as a single block. The dosing system 20 allows a portion to be removed from a supply of solid detergent and discharged into the dishwashing chamber 14 in an automated manner. In the further explanations, it will be assumed that the solid detergent is in tablet form, that is to say is formed by detergent tablets which are produced with a defined, for example approximately cuboid, form. It will be appreciated that the solid detergent can alternatively be a powdered detergent, for example.

In the example shown in FIG. 1, the dosing system 20 is arranged on the door 16. The door 16 has an inner lining panel 22 which is arranged on the inner side of the door 16 facing the dishwashing chamber 14 when the door 16 is closed and is typically manufactured from sheet material. From the side facing the dishwashing chamber, a cover plate part, not shown in greater detail in FIG. 1, can be fitted to the inner lining panel 22, behind which cover plate part various built-in parts of the dosing system 20, for example a supply magazine for detergent tablets or powder and a drop chute for the gravity feed of a portion of the detergent extracted from the supply magazine, can be fitted into the door 16 in a concealed manner. The mentioned cover plate part can serve as the support for a pivoting cover configured according to the invention, as will be explained in greater detail with reference to the further figures. In these further figures, elements which are identical or have an identical effect are in each case provided with identical reference numerals, wherein a different lowercase letter is appended to the reference numerals in order to distinguish between different exemplary embodiments. Unless indicated otherwise hereinbelow, reference is made in respect of such elements with identical reference numerals to the observations made in relation to those figures in connection with which the elements in question are mentioned for the first time.

Figure 2:
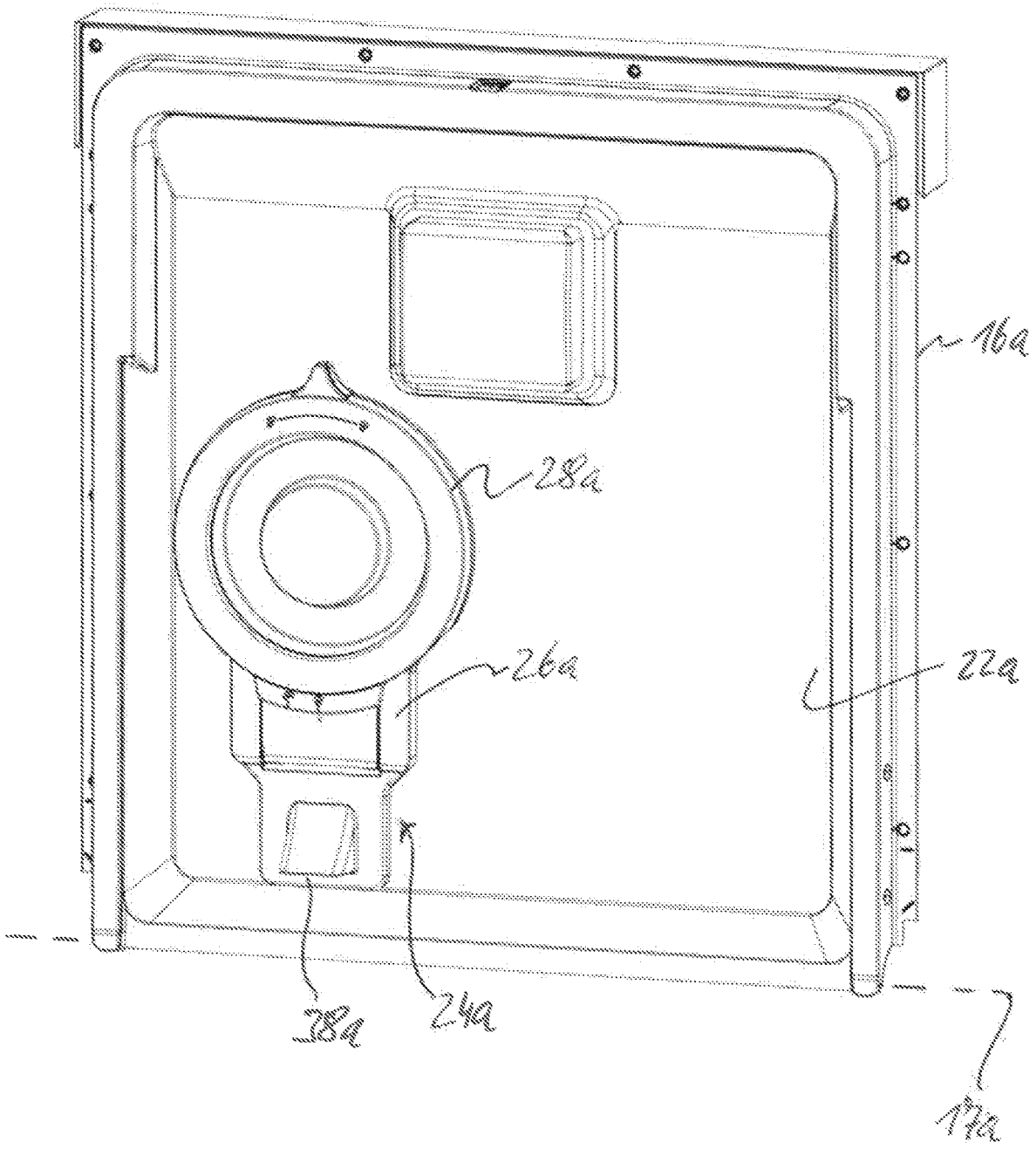
FIG. 2 is a view of the inner side, facing the dishwashing chamber, of a door of a domestic dishwasher according to one embodiment, wherein a magazine cover mounted on the door is closed.
Figure 3:
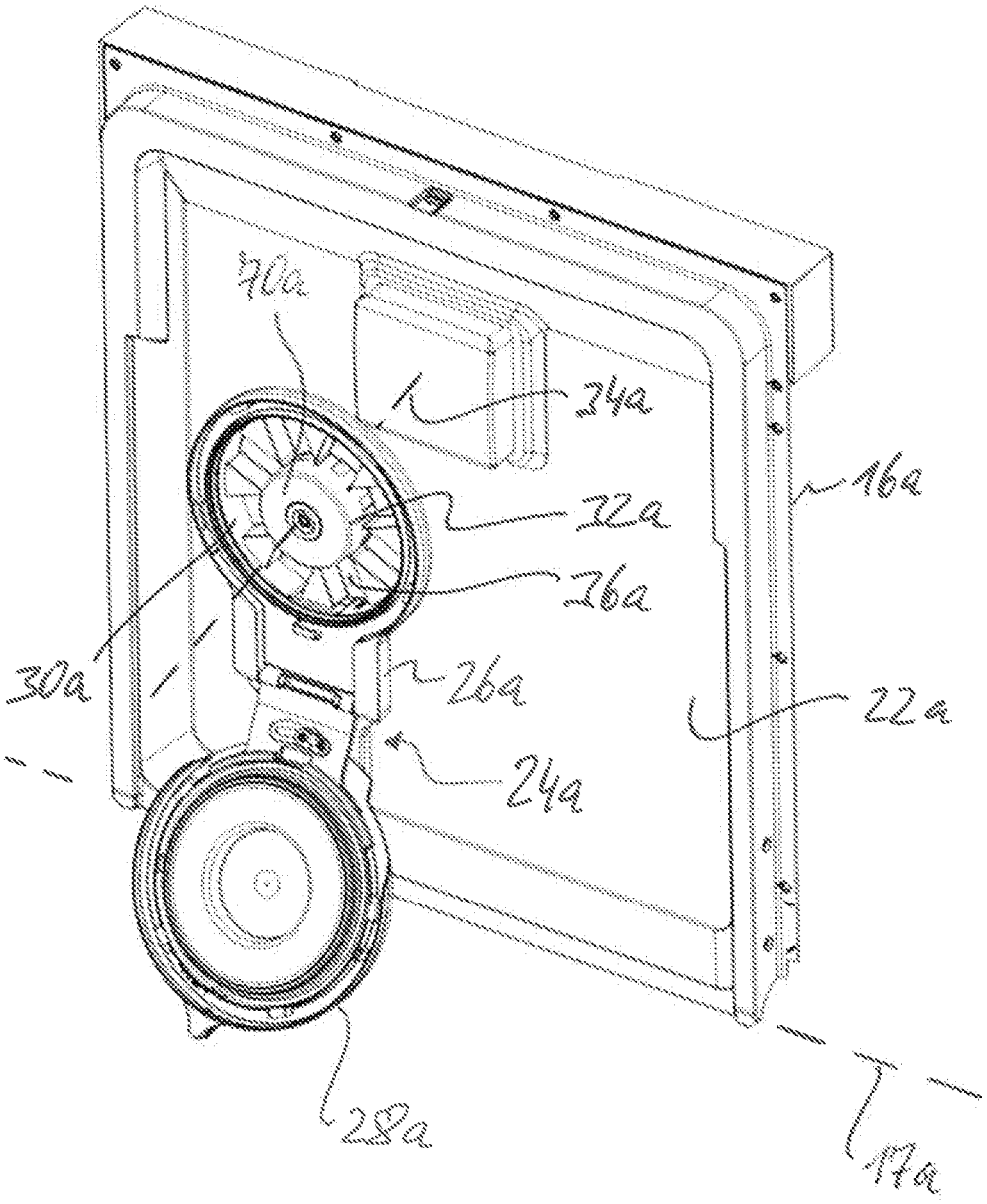
FIG. 3 is a view of the inner side, facing the dishwashing chamber, of the door of FIG. 2 with the magazine cover open.
Figure 5:
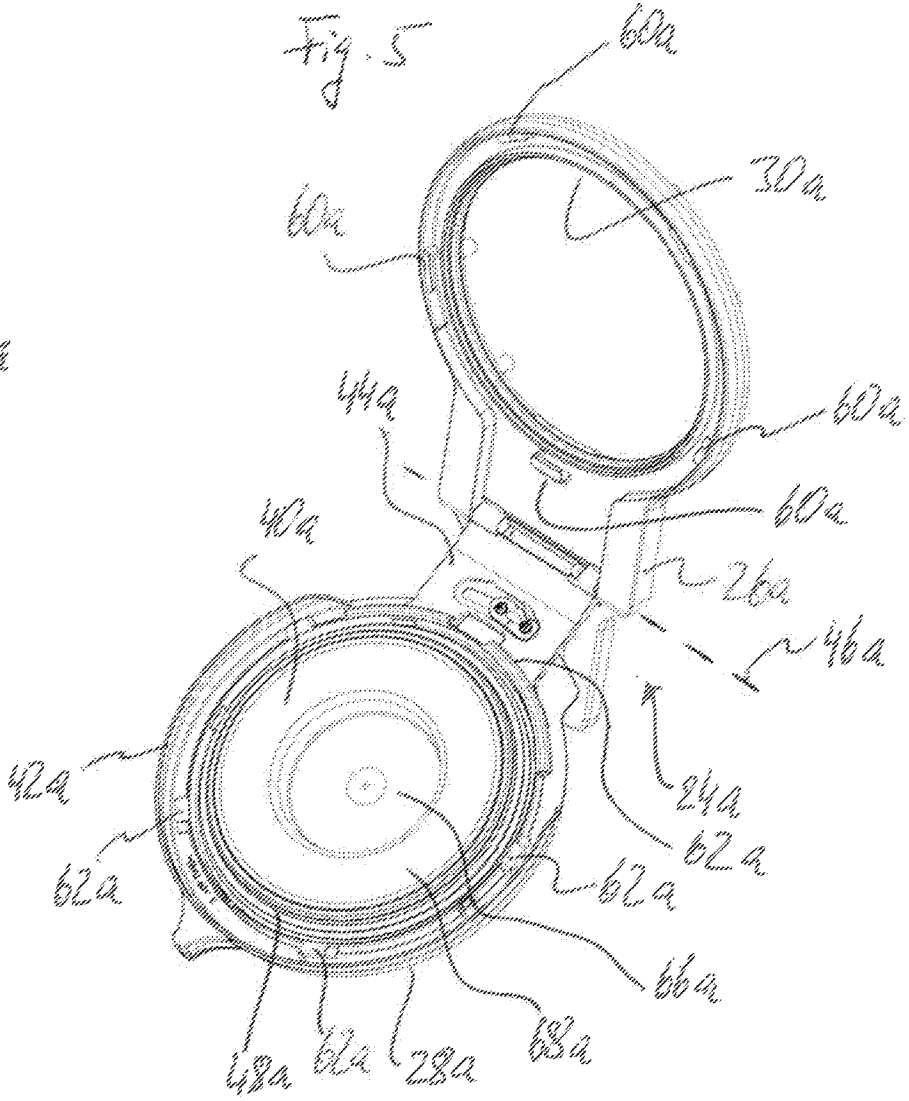
FIG. 5 shows the cover assembly of FIG. 4 with the magazine cover open.

Reference will next be made to FIGS. 2 and 3. There can be seen a cover assembly, designated generally 24*a*, which comprises a cover plate part 26*a* and a magazine cover 28*a* which is mounted on the cover plate part 26*a* so as to be pivotable relative thereto. The cover plate part 26*a* forms a support component for the magazine cover 28*a* and, on mounting, is fitted to the inner lining panel 22*a* from the side thereof facing the dishwashing chamber. In the cover plate part 26*a* there is formed a magazine opening 30*a* (FIG. 3) through which the user can gain access to a supply chamber in which a supply of a solid detergent can be held. In the example shown, the user can gain access through the opening 30*a* to a magazine rotor 32*a* which defines a plurality of supply compartments or cells 36*a* which are arranged distributed about a central rotor axis 34*a* in an annular arrangement and are each to hold at least one cleaning tablet of cuboid form, for example. The magazine opening 30*a* is sufficiently large that the magazine rotor 32*a* can be removed through the magazine opening 30*a*. The magazine rotor 32*a* is part of a dosing system (for example the dosing system 20 of FIG. 1) by means of which individual detergent tablets can be removed from the tablet supply held by the magazine rotor 32*a* and discharged into a drop chute (drop channel), not shown in greater detail in the figures. In the drop chute, the detergent tablets fall to an outlet at which they can emerge into the dishwashing chamber of the dishwasher (for example the dishwasher 10 of FIG. 1). In the mounted situation of the cover assembly 24*a* shown, the drop chute can be arranged concealed behind the cover plate part 26*a*. In the example shown, the outlet is formed by the cover plate part 26*a* and is located at 38*a*. Further explanations relating to the magazine rotor 32*a* and the dosing system equipped therewith can be found in German patent application no. 10 2021 110 759.8 already mentioned.

In the example shown, the cover plate part 26*a* not only forms the opening 30*a* and the outlet 38*a* but at the same time serves as a support component for the pivot mounting of the magazine cover 28*a*. It will be appreciated that, in other embodiments, although the cover plate part 26*a* may still form the opening 30*a* and optionally also the outlet 38*a*, the magazine cover 28*a* may be pivotably mounted on a component separate from the cover plate part 26*a*. For example, it is conceivable to mount the magazine cover 28*a* directly on the inner lining panel 22*a* via a suitable pivot bearing.

Regarding further details of the magazine cover 28*a* and the pivot mounting thereof on the cover plate part 26*a*, reference will now additionally be made to FIGS. 4 to 8.

The magazine cover 28*a* comprises a cover part 40*a*, which is configured in the manner of a circular disk and, when the magazine cover 28*a* is closed, covers substantially the entire opening 30*a*, and a closure ring 42*a* on which the cover part 40*a* is mounted for relative rotation about a (notional) ring axis of the closure ring 42*a*. The closure ring 42*a* is in turn mounted on a hinge component 44*a*, which is mounted on the cover plate part 26*a* so as to be pivotable about a hinge axis 46*a*. The closure ring 42*a* is not fixed immovably to the hinge component 44*a* but is mounted on the hinge component 44*a* so as to be rotatable about its ring axis relative to the hinge component 44*a*. The rotatability of the closure ring 42*a* relative to the hinge component 44*a* can be limited to a comparatively small rotation angle range of, for example, not more than 5 degrees or not more than 8 degrees or not more than 10 degrees or not more than 15 degrees. The rotatability of the closure ring 42*a* relative to the hinge component 44*a* allows the magazine cover 28*a* to be locked and unlocked in a closed pivot position, as is shown in FIG. 4 and in which the magazine cover 28*a* is folded down onto the opening 30*a* and covers the opening.

Forces which act on the cover part 40*a* are thus not transferred directly to the pivot component 44*a* but indirectly via the closure ring 42*a*. The reason for this is that the cover part 40*a* is not mounted directly on the pivot component 44*a* but on the closure ring 42*a*, which in turn is mounted on the pivot component 44*a*.

For fluid-tight closure of the opening 30*a*, it is advantageous to provide an elastomeric sealing element which extends around the opening 30*a* and is compressed or otherwise deformed on closing of the magazine cover 28*a*. In the example of the cover construction 24*a* shown, such an elastomeric sealing element—designated 48*a*—is arranged on the cover part 40*a*. The sealing element 48*a* is formed by a sealing ring having two radial sealing lips 50*a*, 52*a* (FIG. 6), which are axially offset relative to one another with respect to a (notional) axis of revolution, or ring axis, of the sealing element 48*a* and extend in the radial direction to different extents. On closing of the magazine cover 28*a*, the two radial sealing lips 50*a*, 52*a* come into sealing contact with a step profile 54*a* which surrounds the opening 30*a* and is formed by the cover plate part 26*a* and which has two radially inwardly projecting axial shoulders 56*a*, 58*a*. The radial sealing lips 50*a*, 52*a* form with their lip surfaces sealing faces within the meaning of the present invention; the step profile 54*a* forms with its surface encircling the opening 30*a* sealing counter-faces within the meaning of the invention. On closing of the magazine cover 28*a*, each of the radial sealing lips 50*a*, 52*a*, as can readily be seen in FIG. 6, comes into sealing contact with the step profile 54*a* in the region of a respective axial shoulder 56*a*, 58*a*. The radial sealing lips 50*a*, 52*a* can thereby be in direct contact with the respective axial shoulder 56*a* or 58*a* with one of their lip flanks, or they can be in contact with the circumferential surface of the step profile 54*a* substantially only with their lip tip—slightly spaced apart axially from the axial shoulder 56*a*, 58*a* in question.

Figure 4:
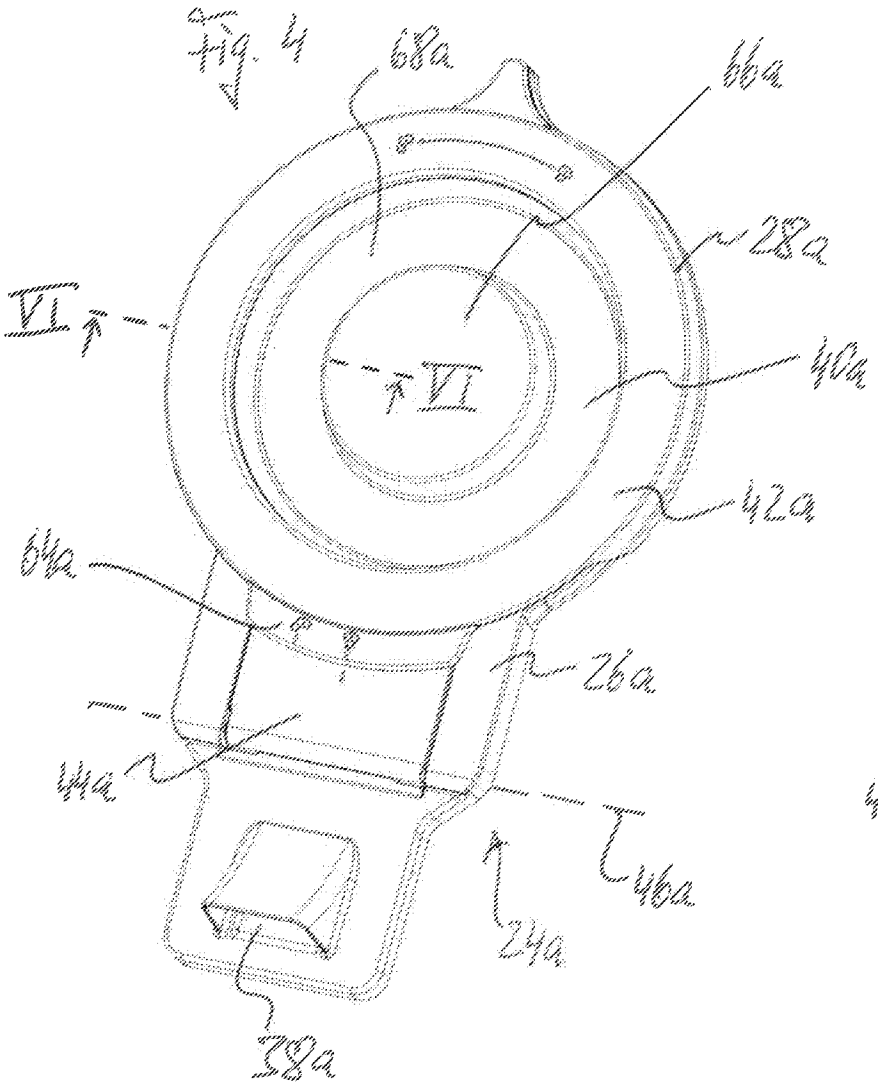
FIG. 4 is a perspective view of a cover assembly containing the magazine cover of FIGS. 2 and 3 with the magazine cover closed.
Figure 6:
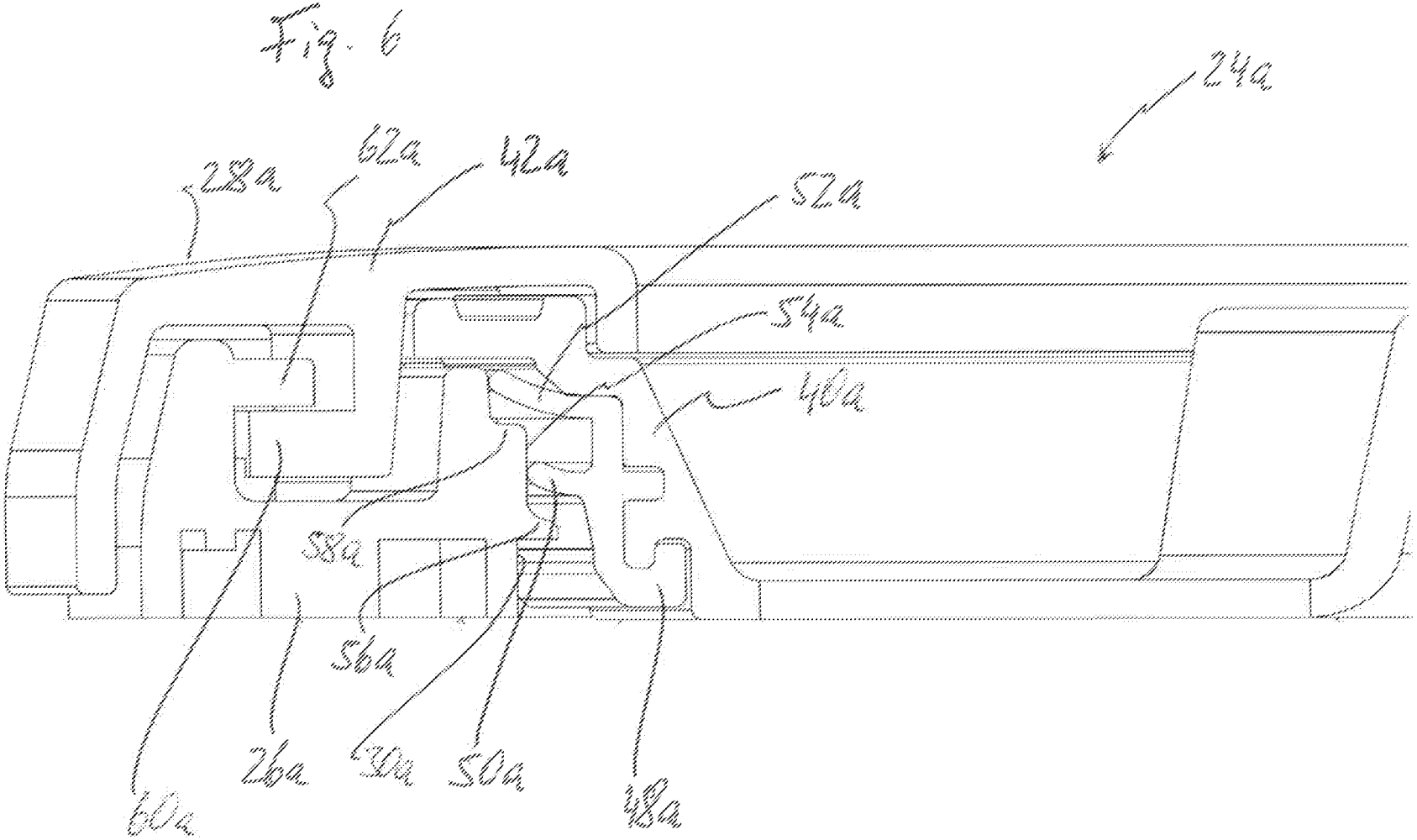
FIG. 6 is a section along line VI-VI in FIG. 4.
Figure 7:
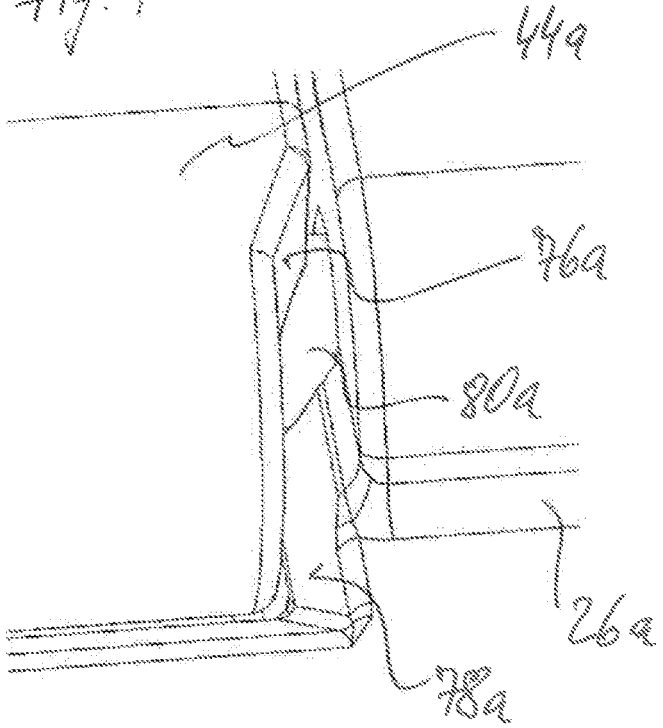
FIG. 7 shows an enlarged detail of a pivot bearing for the magazine cover of FIGS. 2 and 3.
Figure 8:
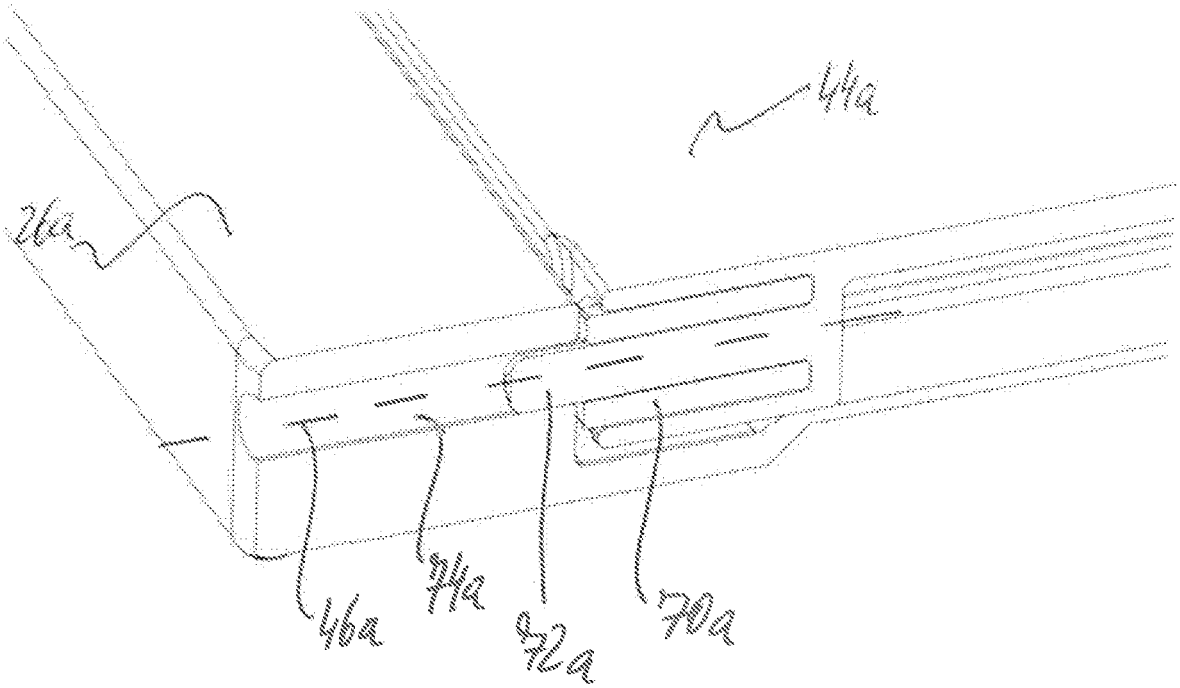
FIG. 8 shows, in partially cut-away perspective, a further detail of the pivot bearing for the magazine cover of FIGS. 2 and 3.
Figure 10:
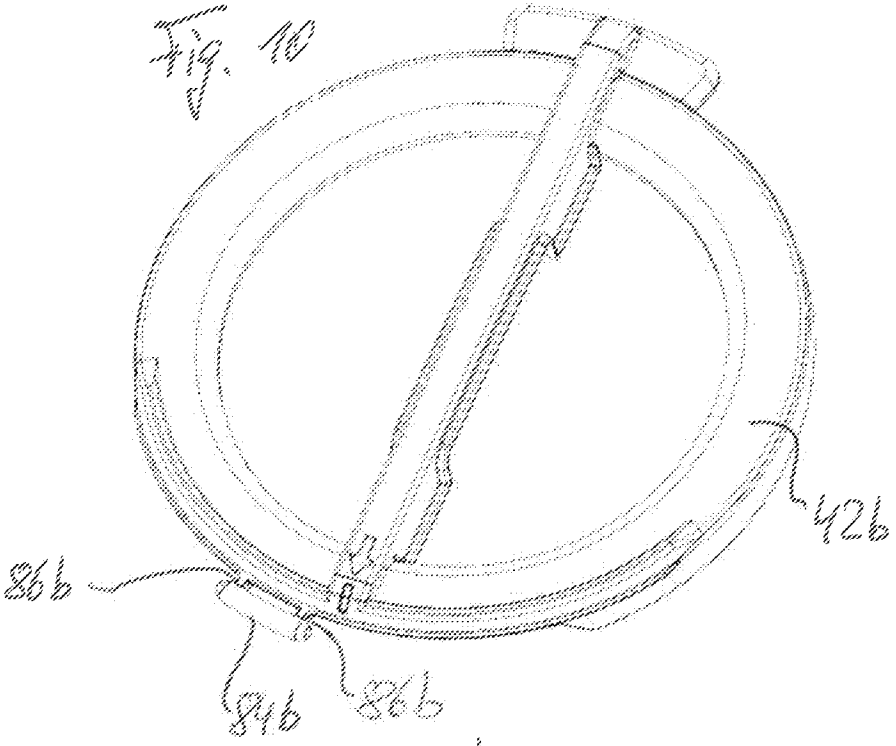
FIG. 10 shows a closure ring of the magazine cover of FIG. 9.
Figure 11:
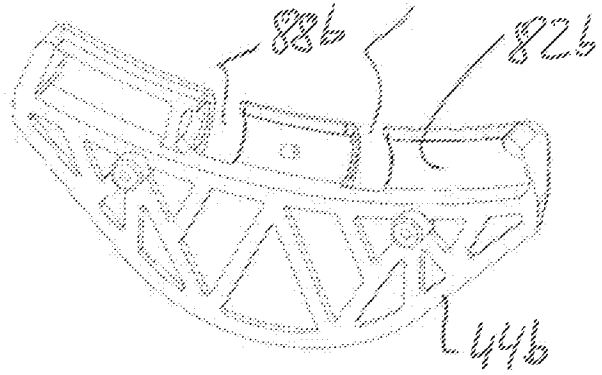
FIG. 11 shows a hinge component for the pivot mounting of the magazine cover of FIG. 9.

The closure ring 42*a* and the cover plate part 26*a* together form a bayonet closure which allows the magazine cover 28*a* to be secured in the closed pivot position according to FIG. 4. For this purpose there is formed on the cover plate part 26*a* a plurality of engagement formations in the form of bayonet formations 60*a* arranged distributed around the opening 30*a*; in spatial association with the bayonet formations 60*a*, a corresponding plurality of locking formations (engagement formations) 62*a*, for example web-like locking formations, is formed on the closure ring 42*a* arranged distributed around the cover part 40*a*. The bayonet formations 60*a* each form a turn-and-push guide for a respective one of the closure formations 62*a*. After the magazine cover 28*a* has been pivoted into its closed pivot position according to FIG. 4, each of the locking formations 62*a* can be moved into the turn-and-push guide formed by the associated bayonet formation 60*a* by relative rotation of the closure ring 42*a* with respect to the cover plate part 26*a*. Mutual holding-closed engagement between the formations 60*a* and 62*a* is thereby established. By relative backward rotation of the closure ring 42*a*, the locking formations 62*a* can be moved out of the turn-and-push guides formed by the bayonet formations 60*a* again; the magazine cover 28*a* can then be opened again. FIG. 4 shows the closure ring 42*a* in a locking rotation position, in which holding-closed engagement between the formations 60*a* and 62*a* has been established. Suitable visible markings 64*a* on the closure ring 42*a* or/and the hinge component 44*a* or/and the cover plate part 26*a* can assist the user in quickly recognizing at a glance whether the magazine cover 28 is properly locked or not.

It will be appreciated that the number of bayonet formations 60*a* and associated locking formations 62*a* is variable. A limitation in terms of number to what is to be seen in the drawings is not intended with the scope of the invention.

In the exemplary embodiment shown, the cover part 40*a* has a relatively raised central region 66*a* which is surrounded by a relatively lowered annular region 68*a*. The raised form of the central region 66*a* can create the necessary receiving space for a hub region 70*a*, which is of raised form, of the magazine rotor 32*a* (see FIG. 3). The raised region 66*a* can be opaque or otherwise non-transparent if it is desired to prevent the user from having a direct view of the hub region 70*a* when the magazine cover 28*a* is closed. By contrast, the annular region 68*a* can be transparent, so that a user can see all the supply compartments 36*a* of the magazine rotor 32*a* at a glance when the magazine cover 28*a* is closed and in particular can determine how many and which of the supply compartments 36*a* are still filled with a detergent tablet. Of course, a non-transparent form of the raised region 66*a* is not a necessity; instead, the raised region 66*a* can also be configured with substantially the same transparency as the annular region 40*a*.

If, with the closure ring 42*a* unlocked, the magazine cover 28*a* is opened from the closed pivot position according to FIG. 4 by pivoting relative to the cover plate part 26*a*, the effect of a damping device begins in the exemplary embodiment shown from a defined opening angle of the magazine cover 28*a*, the damping device damping further pivoting of the magazine cover 28*a* in the opening direction and preventing the magazine cover 28*a* from hitting, in an unchecked manner, an obstacle located in the pivot path of the magazine cover 28*a*. If it is assumed that a user—before opening the magazine cover 28*a*— first moves the door 16*a* into a horizontal position, the further opening movement of the magazine cover 28*a* is assisted by gravity once an opening angle of about 90 degrees has been exceeded. If the user then lets go of the magazine cover 28*a*, the magazine cover 28*a*, in the absence of damping of the pivoting movement thereof, can hit, in an unchecked manner, the outlet 38*a* or a dish rack inserted into the dishwashing chamber of the dishwasher. The braking action of the mentioned damping device begins once the magazine cover 28*a*, starting from the closed pivot position according to FIG. 4, has been opened by a specific opening angle of, for example, at least about 90 degrees or at least about 100 degrees or at least about 110 degrees. In the exemplary embodiment of FIGS. 2 to 8, the braking action is based on friction and is generated by a friction body 70*a* (FIG. 8), which in the example shown is in the form of a sleeve body and is seated on a hinge pin 72*a* formed by the hinge component 44*a*. The hinge pin 72*a* is accommodated in a rotatably mounted manner in a bearing bore 74*a* of the cover plate part 26*a*.

The hinge component 44*a* has a certain axial play with respect to the cover plate part 26*a* (axial with respect to the hinge axis 46*a*). By forced axial displacement of the hinge component 44*a* relative to the cover plate part 26*a*, the friction body 70*a* can be urged into frictional contact with the cover plate part 26*a*. This frictional engagement between the friction body 70*a* and the cover plate part 26*a* provides the desired braking action on the magazine cover 28*a*. In the example shown, on axial displacement of the pivot component 44*a*, the friction body 70*a* is pressed with one of its sleeve end faces against the cover plate part 26*a*.

For the axial forced displacement of the pivot component 44*a* on opening of the magazine cover 28*a*, there are formed on the hinge component 44*a* and the cover plate part 26*a* cooperating wedge faces 76*a*, 78*a* (FIG. 7), which come into mutual wedge engagement from a specific opening angle of the magazine cover 28*a*. In the example shown, the wedge faces 76*a*, 78*a* are formed in the region of the end of the hinge component 44*a* that is axially opposite the hinge pin 72*a* (axial again with respect to the hinge axis 46*a*). In the region of this opposite axial end, the hinge component 44*a* also engages with a (further) hinge pin 80*a* into an associated bearing bore (not shown in greater detail) of the cover plate part 26*a*. The hinge component 44*a* is pivotably mounted on the cover plate part 26*a* via the two hinge pins 72*a*, 80*a*. As soon as the wedge faces 76*a*, 78*a* come into mutual contact, which can be the case, for example, from an opening angle of about 90 degrees or about 100 degrees or about 110 degrees, the mutual wedge engagement of the wedge faces 76*a*, 78*a* effects an axial displacement of the hinge component 44*a*, as a result of which the friction body 70*a* is pressed against the cover plate part 26*a*. As the opening angle increases, the pressing force of the friction body 70*a* on the cover plate part 26*a* increases until the magazine cover 28*a* is finally braked completely. The friction body 70*a* can be manufactured from rubber-elastic material, for example.

Figure 9:
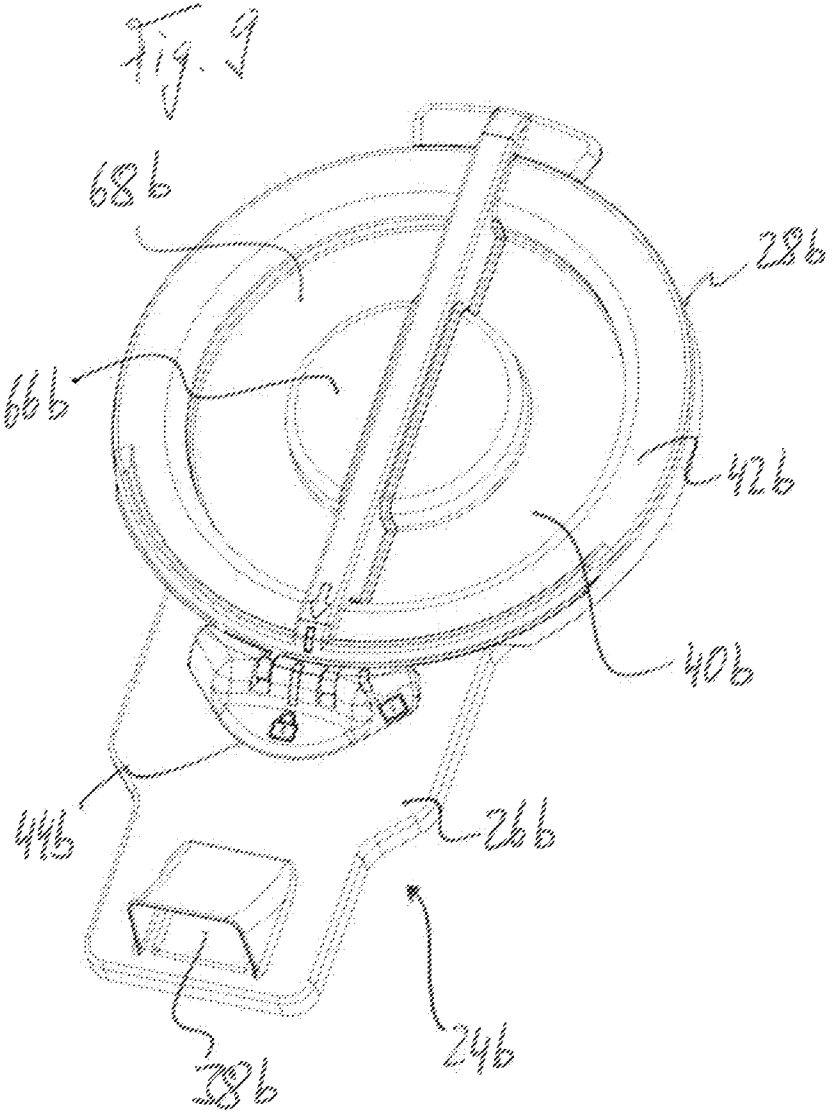
FIG. 9 shows a cover assembly with the magazine cover closed according to a further exemplary embodiment.

Reference will now be made to the exemplary embodiment of FIGS. 9 to 13*b*. This differs from the exemplary embodiment of FIGS. 2 to 8 substantially by a pivotally fixed attachment of the hinge component 44*b* to the cover plate part 26*b*. In contrast to the preceding exemplary embodiment, the closure ring 42*b* is not only mounted for relative rotation on the hinge component 44*b* but in addition is pivotable relative to the hinge component 44*b* between the closed pivot position, as is shown in FIG. 9, and an open pivot position, in which an opening (not shown in greater detail in FIGS. 9 to 13*b*) which can be closed by means of the magazine cover 28*b* is accessible to a user. The mounting of the closure ring 42*b* on the pivot component 44*b* accordingly offers a double degree of freedom, namely on the one hand relative rotatability in the closed pivot position of the magazine cover 28*b* and on the other hand pivotability for opening and closing the magazine cover 28*b*.

For this type of combined pivoting and rotating mounting, the hinge component 44*b* forms a curved guiding channel 82*b* for a bearing pin 84*b* which is arcuately curved and arranged on the closure ring 42*b* and which is movable to and fro in the curved guiding channel 82*b* by rotation of the closure ring 42*b* between a first channel end position according to FIG. 12*b* and a second channel end position according to FIG. 13*b*. The first channel end position corresponds to an unlocking position of the closure ring 42*b* according to FIG. 12*a*, and the second channel end position corresponds to a locking position of the closure ring 42*b* according to FIG. 13*a*. In the locking position, the magazine cover 28*b* cannot be opened; in the unlocking position, the magazine cover 28*b* can be pivoted into the open pivot position. In the example shown, the bearing pin 82*b* is connected to the closure ring 42*b* via two bridging webs 86*b*. The hinge component 44*b* has two pivot recesses 88*b* which are arranged at the same distance from one another as the bridging webs 86*b* and which, in the first channel end position of the guiding pin 84*b*, allow the closure ring 42*b* to pivot relative to the hinge component 44*b*. In the second channel end position of the bearing pin 84*b*, on the other hand, the bridging webs 86*b* are out of alignment with the pivot recesses 88*b*; pivoting of the closure ring 42*b* from the closed pivot position is not possible in this rotation position of the closure ring 42*b*.

What is claimed is:

1. A cover assembly for mounting in a domestic appliance, the cover assembly comprising a pivoting cover which is mounted on a support component and is to close an opening, wherein the pivoting cover includes a cover part and a closure part which is movable relative to the cover part, wherein the cover part has sealing faces which, on closing of the pivoting cover, come into sealing contact with sealing counter-faces encircling the opening, wherein there are formed on the closure part engagement formations configured to be brought, in a closed pivot position of the pivoting cover, into and out of holding-closed engagement with engagement counter-formations by relative movement between the closure part and the support component, wherein the cover part is mounted on the closure part and is supported via the closure part on the support component, wherein a sealing element is arranged on the cover part, wherein the sealing element forms at least part of the sealing faces or of the sealing counter-faces and has a pair of flexibly deflectable radial sealing lips which are offset axially with respect to an axis of revolution normal to a plane of revolution of the sealing element and extend in a same radial direction, and wherein on closing of the pivoting cover, the two radial sealing lips come into sealing contact with a step profile which surrounds the opening and is formed by a cover plate part and which has two radially inwardly projecting axial shoulders.

2. The cover assembly as claimed in claim 1, wherein the closure part is mounted on the support component via a pivot bearing which, in addition to a relative pivoting movement between the closure part and the support component, at least in the closed pivot position of the pivoting cover permits a relative movement between the closure part and the support component in order to establish and release the holding-closed engagement.

3. The cover assembly as claimed in claim 1, comprising an intermediate component which is pivotably mounted on the support component and on which the closure part is mounted for relative movement in order to establish and release the holding-closed engagement.

4. The cover assembly as claimed in claim 1, wherein at least part of the sealing faces is formed by an elastomer seal arranged on the cover part.

5. The cover assembly as claimed in claim 1, wherein the cover part is configured in the manner of a circular disk part, wherein the closure part comprises an annular region surrounding the cover part and is rotatable relative to the cover part for establishing and releasing the holding-closed engagement.

6. The cover assembly as claimed in claim 1, wherein the cover part is non-transparent in a first region which is situated over the opening centrally in the closed pivot position of the pivoting cover and is transparent in a second region surrounding the first region.

7. The cover assembly as claimed in claim 1, wherein the cover part is relatively elevated in a first region which is situated over the opening centrally in the closed pivot position of the pivoting cover and is relatively lowered in a second region surrounding the first region.

8. The cover assembly as claimed in claim 1, wherein the support component comprises an integrally connected portion having formed therein the opening and, spaced apart from the opening, a detergent outlet.

9. The cover assembly as claimed in claim 1, comprising a damping device effective between the support component and the pivoting cover to generate a pivot resistance which begins from a defined pivot angle distance from the closed pivot position of the pivoting cover.

10. The cover assembly as claimed in claim 9, wherein the defined pivot angle distance is not less than 60 degrees or not less than 80 degrees or not less than 90 degrees from the closed pivot position of the pivoting cover.

11. The cover assembly as claimed in claim 1, comprising a damping device effective between the support component and the pivoting cover to generate a pivot resistance which increases as the pivot angle distance from the closed pivot position of the pivoting cover increases.

12. A domestic dishwasher comprising:

a dishwashing container having a dishwashing chamber;

a door for closing the dishwashing chamber, the door being mounted on the dishwashing container so as to be pivotable about a horizontal door pivot axis; and a dosing system, disposed on the door, for a solid detergent, wherein the dosing system defines a supply chamber, accessible through a charging opening, for holding a supply of the solid detergent, and a drop section, leading to an outlet, for a portion of the detergent extracted from the supply, wherein the outlet is designed to allow the extracted detergent portion to emerge into the dishwashing chamber, and wherein the dosing system comprises a cover assembly as claimed in claim 1 for closing the charging opening.

* * * * *